US006908250B2

(12) United States Patent
Moffatt

(10) Patent No.: US 6,908,250 B2
(45) Date of Patent: Jun. 21, 2005

(54) RETAINER FOR RETAINING COLLAPSED POLES WITHIN ANOTHER POLE

(75) Inventor: Wilbur Keith Moffatt, Freeport, IL (US)

(73) Assignee: Greenlee Textron Inc., Rockford, IL (US)

( * ) Notice: Subject to any disclaimer, the term of this patent is extended or adjusted under 35 U.S.C. 154(b) by 0 days.

(21) Appl. No.: 10/694,134

(22) Filed: Oct. 27, 2003

(65) Prior Publication Data

US 2004/0084915 A1 May 6, 2004

Related U.S. Application Data

(62) Division of application No. 10/280,196, filed on Oct. 25, 2002, now Pat. No. 6,729,358.

(51) Int. Cl.[7] ..... B65D 45/02; B65F 1/16

(52) U.S. Cl. ..... 403/109.2; 403/377; 24/3.13; 24/442; 220/8; 220/315; 220/324

(58) Field of Search ..... 403/109.1–109.8, 403/377, 379.1, 379.6; 24/306, 442, 447, 3.13; 220/8, 324, 315

(56) References Cited

U.S. PATENT DOCUMENTS

| | | | | |
|---|---|---|---|---|
| 632,324 A | | 9/1899 | Pottenger | |
| 1,975,110 A | | 10/1934 | Louckes | |
| 2,222,366 A | | 11/1940 | Glass | |
| 2,245,126 A | | 6/1941 | Day | |
| 2,542,665 A | | 2/1951 | Gustafson | |
| 2,688,510 A | | 9/1954 | Heyser | |
| 2,700,252 A | | 1/1955 | Paganelll | |
| 2,811,127 A | | 10/1957 | Palsson | |
| 2,889,797 A | | 6/1959 | Fox | |
| 3,072,429 A | | 1/1963 | Stipan | |
| 3,150,460 A | | 9/1964 | Dees | |
| D224,757 S | | 9/1972 | Bolen, Jr. | |
| 3,763,872 A | | 10/1973 | Gooley | |
| 3,774,953 A | | 11/1973 | Babcock | |
| 3,788,691 A | | 1/1974 | McMullin | |
| 3,813,122 A | | 5/1974 | Wemyss | |
| 3,828,716 A | | 8/1974 | Bernardi | |
| 3,861,731 A | | 1/1975 | Young | |
| 3,865,498 A | * | 2/1975 | Okuto et al. | 403/292 |
| 3,873,143 A | | 3/1975 | Foust | |
| 3,893,725 A | * | 7/1975 | Coulter et al. | 24/306 |
| 3,918,385 A | | 11/1975 | Wallace | |
| 3,936,088 A | | 2/1976 | Williams | |
| 3,936,206 A | | 2/1976 | Meisberger | |

(Continued)

FOREIGN PATENT DOCUMENTS

GB 1078254 A * 8/1967

OTHER PUBLICATIONS

One (1) page of Crain Enterprises' LR Series Leveling Rods printed from the internet—Mar. 6, 2002.

One (1) page of Crain Enterprises' CR Series Leveling Rods printed from the internet—Mar. 6, 2002.

One (1) page of Crain Enterprises' SVR/USL Series Leveling Rods printed from the internet—Mar. 6, 2002.

*Primary Examiner*—Daniel P. Stodola
*Assistant Examiner*—Ernesto Garcia
(74) *Attorney, Agent, or Firm*—Trexler, Bushnell, Giangiorgi, Blackstone & Marr, Ltd.

(57) ABSTRACT

A tool is provided and includes a hook member which is attached to an extendable and retractable pole member, and a retainer which can retain the pole member in a collapsed position. The hook member is used to twist a short portion of a workpiece around a long portion of a workpiece in order to secure the short portion to the long portion when the workpiece is hung from an overhead support member. The retainer retains an inner pole of the pole member within an outer pole of the pole member when the pole member is in a collapsed position.

5 Claims, 9 Drawing Sheets

U.S. PATENT DOCUMENTS 3,940,144 A * 2/1976 Dickie ..... 24/3.13
3,993,013 A 11/1976 Nunziato et al.
4,004,539 A 1/1977 Wesson
4,037,554 A 7/1977 Foscolo
4,079,978 A 3/1978 McMullin
D248,012 S 5/1978 Rensen
4,105,239 A 8/1978 Akczinski, Sr.
4,121,531 A 10/1978 Norton
D253,277 S 10/1979 Hernsjo
4,263,864 A 4/1981 Carter, Jr. et al.
4,385,849 A 5/1983 Crain
4,694,869 A 9/1987 Wolford, Jr. et al.
4,789,200 A * 12/1988 Munguia ..... 403/377
4,976,371 A * 12/1990 Wise et al. ..... 220/315
5,054,829 A 10/1991 Olsen
5,058,306 A 10/1991 Sienel
5,220,707 A 6/1993 Newman, Sr. et al.
5,292,160 A 3/1994 Deichman
5,339,953 A * 8/1994 Alex et al. ..... 220/318
5,579,558 A 12/1996 Newman, Jr. et al.
5,622,399 A 4/1997 Albright
5,692,856 A 12/1997 Newman, Jr. et al.
5,704,669 A 1/1998 Clark
5,740,939 A * 4/1998 Muldner et al. ..... 220/495.11
5,743,577 A 4/1998 Newman, Jr. et al.
5,832,651 A 11/1998 Arntz
5,938,035 A * 8/1999 Oglesby et al. ..... 220/8
6,085,681 A 7/2000 Morton
D452,777 S 1/2002 Newman et al.
6,694,525 B1 * 2/2004 Murnan ..... 2/12

* cited by examiner

RETAINER FOR RETAINING COLLAPSED POLES WITHIN ANOTHER POLE

CROSS-REFERENCE

This patent application is a divisional application of U.S. patent application Ser. No. 10/280,196, filed Oct. 25, 2002 now U.S. Pat. No. 6,729,358, and entitled "Wire Twisting Tool".

BACKGROUND OF THE INVENTION

The present invention relates to a tool for twisting a workpiece, such as wire, about itself to secure the workpiece to an overhead support member from which the workpiece is suspended. The tool can be operated by a user located a distance from the overhead support members, such that the user need not stand on a ladder or scaffolding to twist the workpiece, but may rather stand on the floor to accomplish same. The present invention also relates to a tool having a retainer for retaining collapsed poles within another pole. The retainer can be easily released to allow extension of the poles or locked to retain the poles in a collapsed position.

Tools used to perform the task of twisting a workpiece have existed for some time. One such tool is discussed in U.S. Pat. No. 4,694,869 and is entitled "Tool For Wrapping Drop Wires For Suspended Grid Ceiling". This tool, however, is expensive to manufacture and can be difficult to use. Tools have also been used which allow a user to stand on the floor or ground to accomplish a task overhead without the use of a ladder or scaffolding. Many of these tools utilize extensible and retractable poles, such as those discussed in U.S. Pat. No. 4,385,849.

Problems with such extensible and retractable poles lie in the retaining of inner poles within the outer poles when the poles are collapsed within themselves. Such poles have the potential of the pole being extended unexpectedly by gravity while being carried, with such extension possibly resulting in a trip hazard or, at a minimum, a nuisance to the user.

One way in which this problem has been addressed is to provide a vinyl cap/hood or rubber stopper to address the problem. The cap/stopper approach, though, requires the hook/tool on the pole end, such as a twister hook of the present invention, to be removed before the cap/plug can be installed. If the cap/plug is separate, it can be easy to lose. Further, if the cap/plug is tethered to the poles, it can annoyingly be dangling in the line of sight of the user and/or can get caught on structure resulting in annoyance as well. Such caps/plugs can also be expensive to make as they are often molded. Caps/plugs can also be split, cut or torn in the field.

Therefore, a new tool used for twisting workpieces is desirable. A new tool for retaining poles which are collapsed within one another is also desirable. The present invention provides such a tool and the tool overcomes the disadvantages of the prior art. Features and advantages of the present invention will become apparent upon a reading of the attached specification, in combination with a study of the drawings.

OBJECTS AND SUMMARY OF THE INVENTION

A primary object of the invention is to provide a tool having a hook member which can be attached to a pole member which is configured to allow a user to quickly and efficiently twist a first portion of a workpiece around a second portion of a workpiece to secure the portions of the workpiece together and to an overhead support member.

Another object of the invention is to provide a tool which can be rotated either clockwise or counter-clockwise to twist a first portion of a workpiece around a second portion of a workpiece to secure the portions of the workpiece together and to an overhead support member.

Another object of the invention is to provide a hook member which is inexpensive to manufacture which can twist a first portion of a workpiece around a second portion of a workpiece to secure the portions of the workpiece together and to an overhead support member.

Yet another object of the invention is to provide a tool which is easy for a user to use.

Yet another object of the invention is to provide a tool having a pole member which is retractable to allow for easy storage of the tool, and which is extensible to allow the tool to reach heights normally only reached by a user standing on a ladder, scaffolding or the like.

Still another object of the invention is to provide a retaining member for a pole member which is extensible and retractable which is compact and is out of the line of the user's line of sight when the pole member is extended.

Another object of the invention is to provide a retaining member for a pole member which is extensible and retractable which is relatively inexpensive to make and no tooling dollars are required.

Yet another object of the invention is to provide a retaining member for a pole member which is extensible and retractable which has no loose pieces which can get lost in the field.

Another object of the invention is to provide a retaining member for a pole member which is extensible and retractable which is durable such that it will not split, cut or tear.

Yet another object of the invention is to provide a retaining member for a pole member which is extensible and retractable which does not require the hook/tool on the end of the pole member to be removed for the retaining member to be used.

Briefly, and in accordance with the foregoing, the present invention provides a tool which includes a hook member which is attached to an extendable and retractable pole member, and a retainer which can retain the pole member in a collapsed position. The hook member is used to twist a first portion of a workpiece around a second portion of a workpiece in order to secure the first portion to the second portion when the workpiece is hung from an overhead support member. The retainer retains an inner pole of the pole member within an outer pole of the pole member when the pole member is in a collapsed position.

BRIEF DESCRIPTION OF THE DRAWINGS

The features of the present invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENTS

Figure 1:
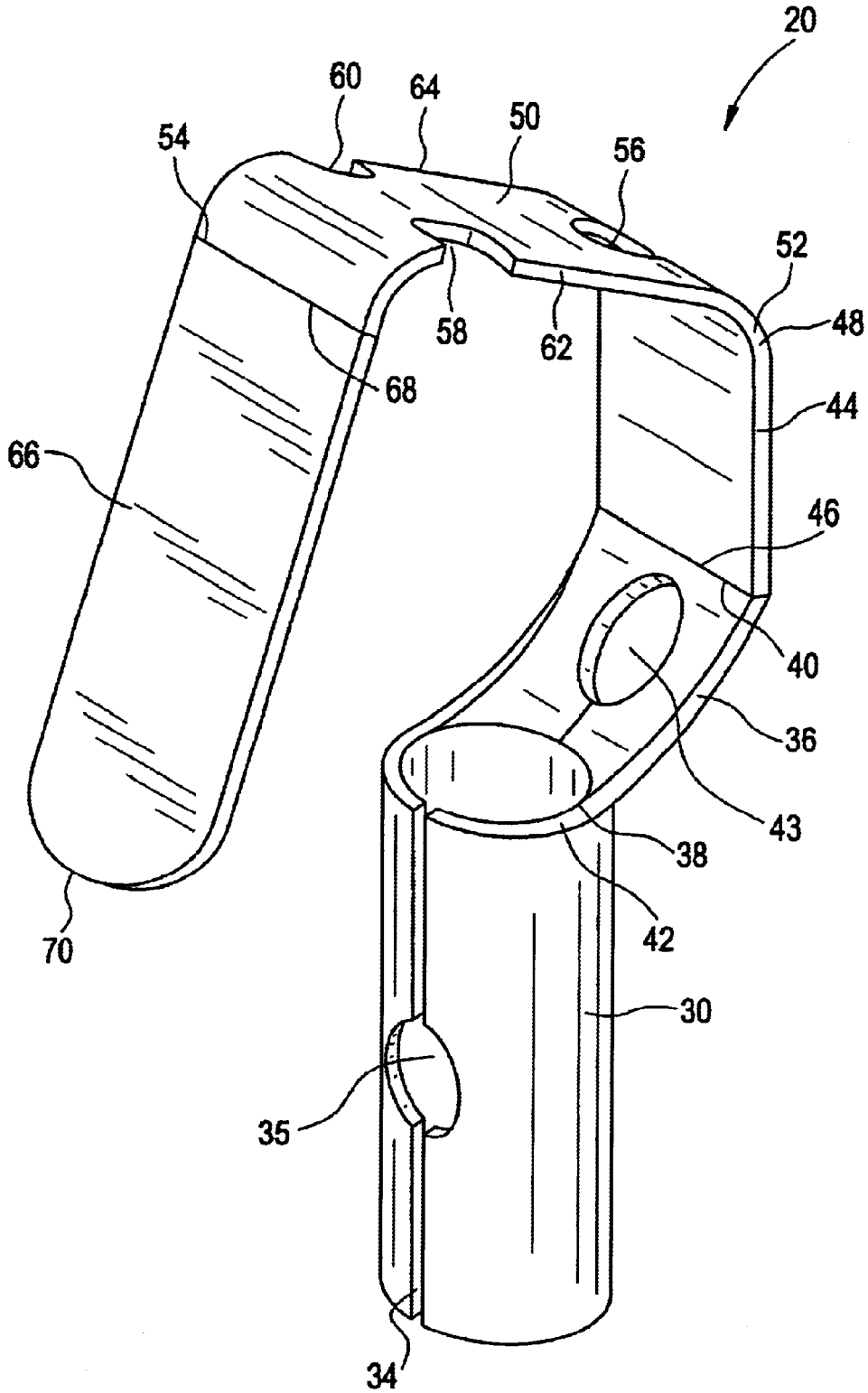
FIG. 1 is a perspective view of a hook member for a tool which incorporates features of the invention.

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated and described herein.

Attention is directed to FIGS. 1–4 which illustrate a hook member 20 for use on a tool 24, 24*a*. The hook member 20 is preferably attached to a pole member 22, 22*a* to provide the tool 24, 24*a* which is utilized for securing or twisting a workpiece 26, such as wire or rope, onto an overhead support member 28. The hook member 20 is preferably stamped from metal and thereafter bent to form such that it is relatively inexpensive to manufacture.

The hook member 20 has a first portion 30 which is preferably cylindrical such that the first portion 30 of the hook member 20 can be positioned around an end portion 32, 32*a* of the pole member 22, 22*a*. The first portion 30 has a centerline Y—Y which is aligned with the centerline of the tool 24, 24*a*. The first portion 30 may have a slot 34 which extends the length thereof to allow for the ability to position the hook member 20 on pole members 22, 22*a* of different diameters. The slot 34 also has an enlarged, generally circular portion 35 thereof which allows for a button 104, 104*a* of the pole member 22, 22*a* to be positioned therein, as will be discussed further herein.

Figure 2:
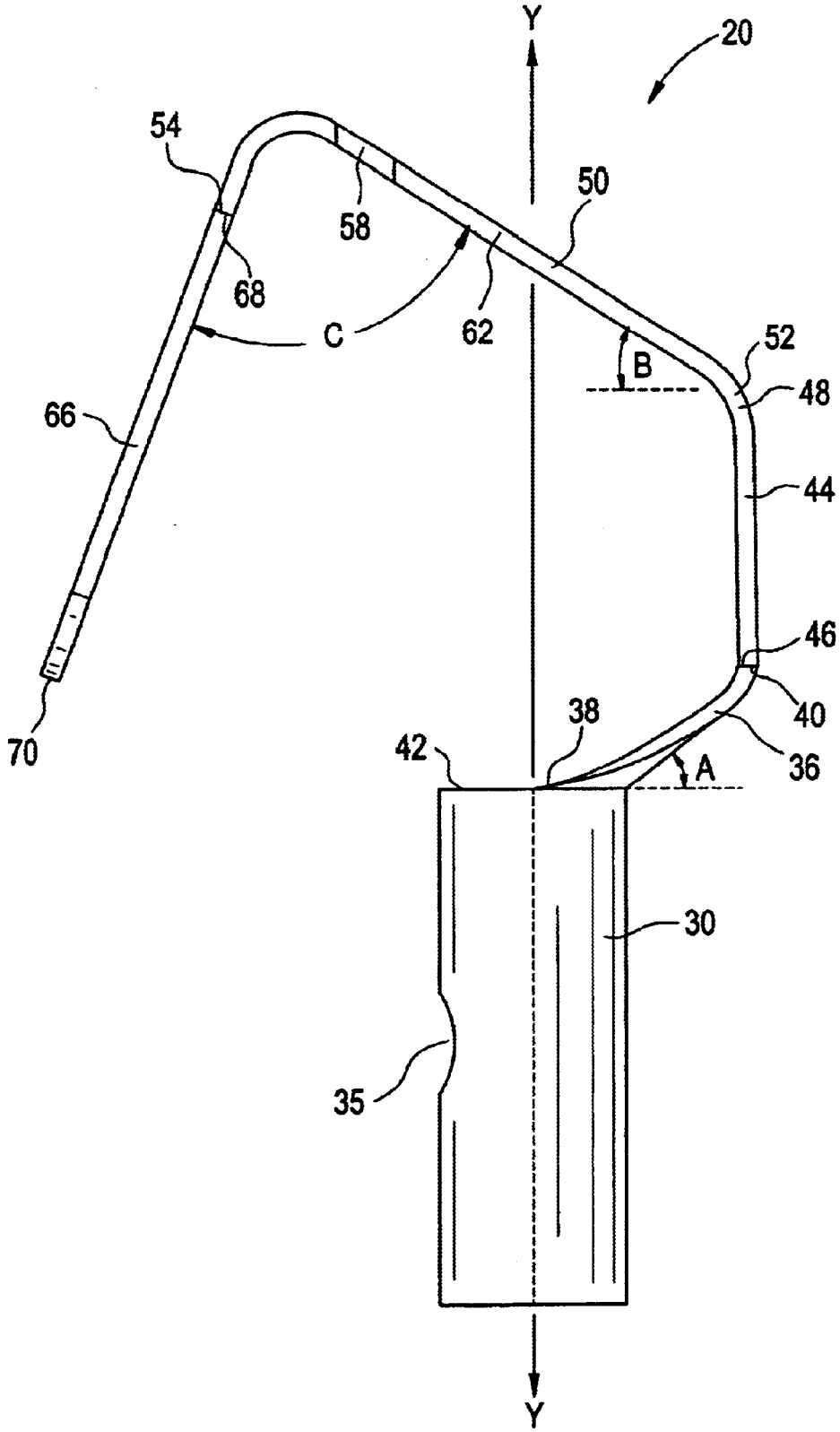
FIG. 2 is a side-elevational view of the hook member shown in FIG. 1.
Figure 3:
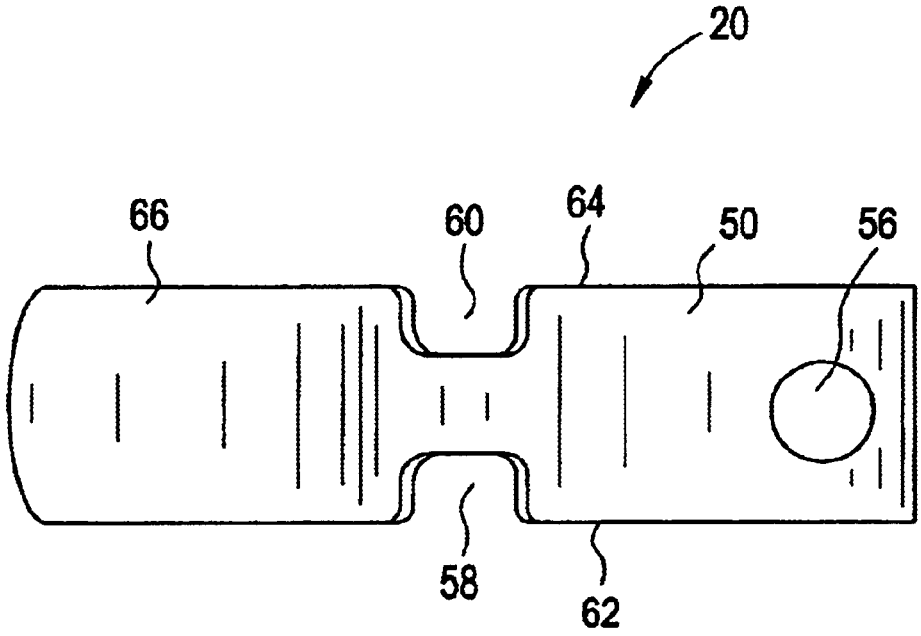
FIG. 3 is a top plan view of the hook member shown in FIG. 1.
Figure 4:
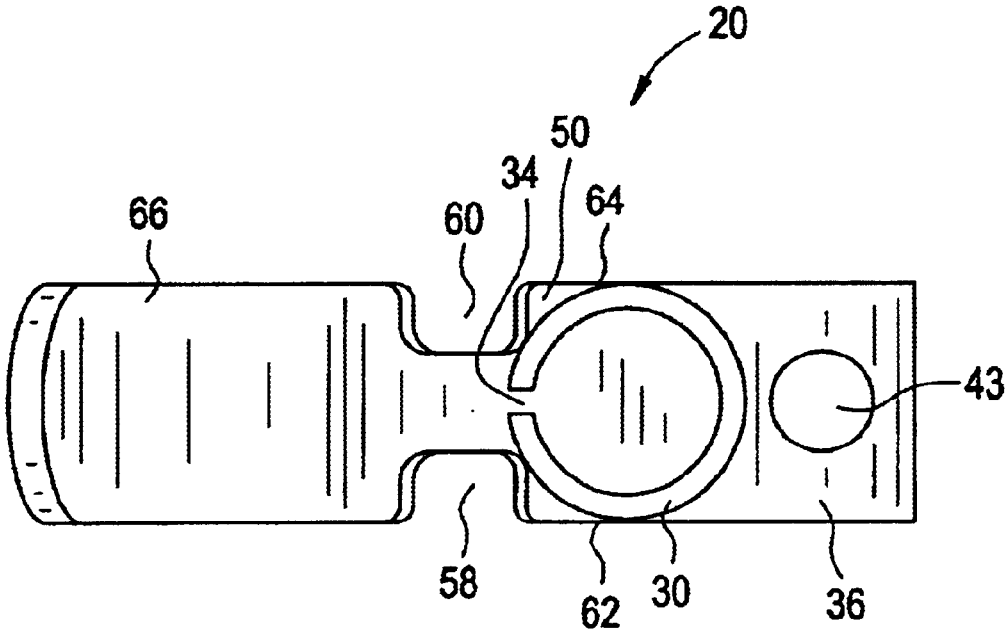
FIG. 4 is a bottom plan view of the hook member shown in FIG. 1.

The hook member 20 has a second portion 36 having first and second ends 38, 40. As illustrated in FIGS. 1 and 2, the first end 38 of the second portion 36 is connected to a portion of an end 42 of the first portion 30. From the first end 38 of the second portion 36, the second portion 36 extends upwardly and to the right of centerline Y—Y at an angle A from a line perpendicular to centerline Y—Y, when viewed as in FIG. 2, toward the second end 40 thereof such that the second end 40 of the second portion 36 of the hook member 20 is positioned further to the right of centerline Y—Y than the first portion 30 of the hook member 20 and the pole member 22, 22*a*. Angle A is preferably 30 degrees. The second portion 36 may extend either straight from the first end 38 to the second end 40, or may be slightly curved from the first end 38 to the second end 40. An aperture 43 is provided through the second portion 36 of the hook member 20 such that the aperture 43 is offset from the first portion 30 of the hook member 20 and the pole member 22, 22*a*.

The hook member 20 has a third portion 44 having first and second ends 46, 48. As illustrated in FIGS. 1 and 2, the first end 46 of the third portion 44 is connected to the second end 40 of the second portion 36. From the first end 46 of the third portion 44, the third portion 44 extends upwardly to the second end 48 thereof such that the third portion 44 is generally parallel to the first portion 32 of the hook member 20 and the pole member 22, 22*a*.

The hook member 20 has a fourth portion 50 having first and second ends 52, 54. As illustrated in FIGS. 1 and 2, the first end 52 of the fourth portion 50 is connected to the second end 48 of the third portion 44. From the first end 52 of the fourth portion 50, the fourth portion 50 extends angularly upwardly and to the left, beyond centerline Y—Y when viewed as in FIG. 2, at an angle B from a line perpendicular to centerline Y—Y toward the second end 54 thereof, which is positioned on the other side of the first portion 30 of the hook member 20 and the pole member 22, 22*a* than is the third portion 44, such that the second end 54 of the fourth portion 50 is positioned further to the left of centerline Y—Y than the first portion 30 of the hook member 20 and the pole member 22, 22*a*. Angle B is preferably 25 degrees. The fourth portion 50 extends generally straight from the first end 52 to the second end 54. An aperture 56 is provided through the fourth portion 50 of the hook member 20 such that the aperture 56 is offset from the first portion 30 of the hook member 20 and the pole member 22, 22*a* in the same direction in which the aperture 43 is offset from the first portion 30 of the hook member 20 and the pole member 22, 22*a*. The apertures 43, 56 are provided such that they are in alignment with one another and on an axis parallel to the centerline Y—Y.

The fourth portion 50 has a pair of notches 58, 60 provided along outer edges 62, 64 thereof, respectively. The notches 58, 60 are provided proximate to, but spaced from, the second end 54 of the fourth portion 50 such that notches 58, 60 are positioned further to the left of centerline Y—Y than the first portion 30 of the hook member 20 and the pole member 22, 22*a*.

The hook member 20 has a fifth portion 66 having first and second end 68, 70. As illustrated in FIGS. 1 and 2, the first end 68 of the fifth portion 66 is connected to the second end 54 of the fourth portion 50. From the first end 68 of the fifth portion 66, the fifth portion 66 extends angularly downwardly and to the left of centerline Y—Y when viewed as in FIG. 2, at an angle C relative to outer edge 62 to the second end 70 thereof, which is preferably rounded, such that the second end 70 of the fifth portion 66 is generally positioned further to the left of centerline Y—Y than is the second end 54 of the fourth portion 50. Angle A is preferably 75 degrees.

Figure 5:
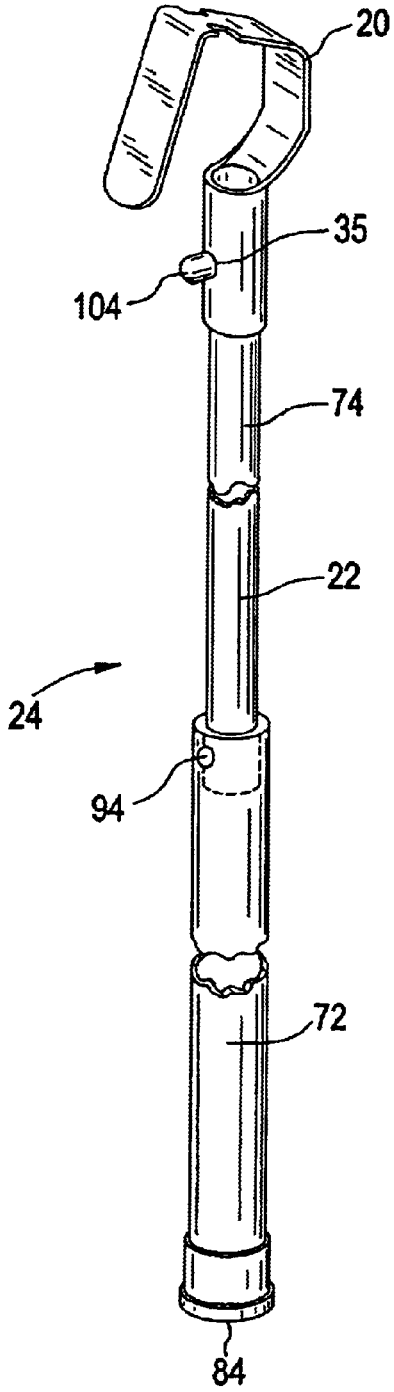
FIG. 5 is a perspective view of the hook member shown in FIG. 1 connected to an extensible and retractable pole member which is formed in accordance with a first embodiment of the invention.

In a first embodiment of the tool 24, the hook member 20 is connected to the pole member 22, as illustrated in FIG. 5.

Figure 8:
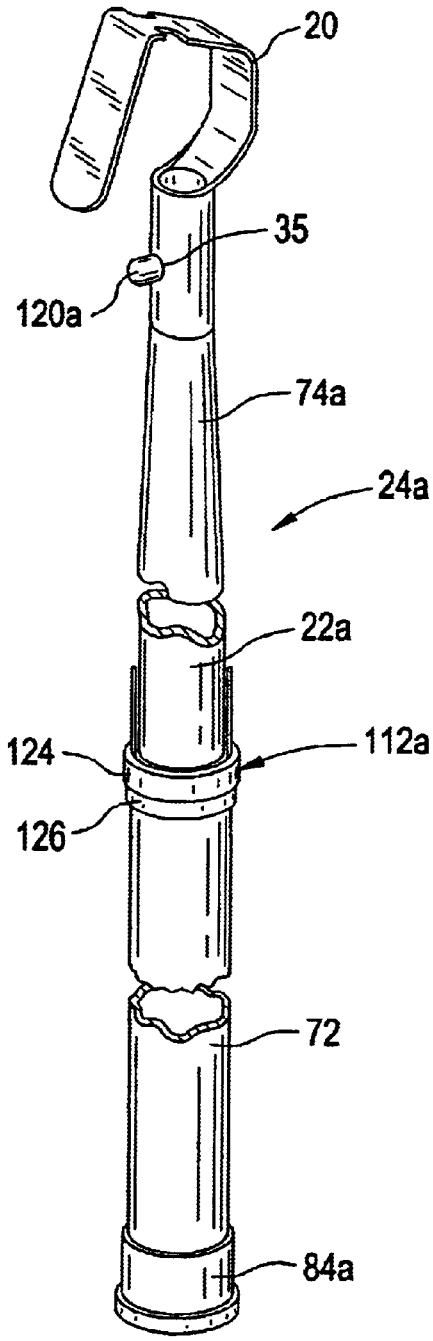
FIG. 8 is a perspective view of the hook member connected to an extensible and retractable pole member which is formed in accordance with a second embodiment of the invention.

In a second embodiment of the tool 24*a*, the hook member 20 is connected to the pole member 22*a*, as illustrated in FIG. 8. Each of the pole members 22, 22*a* are of the extensible and retractable type. Of course it should be noted that the pole member need not be of the extensible and retractable type.

Figure 6:
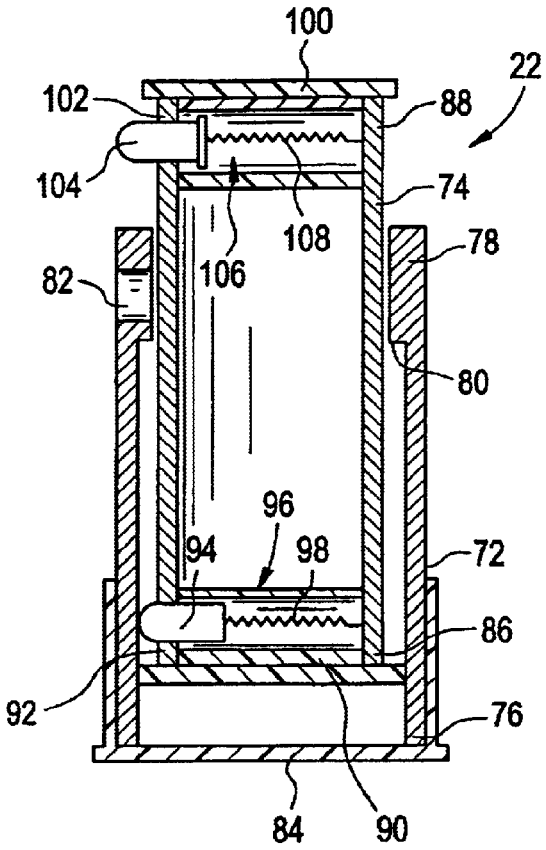
FIG. 6 is a cross-sectional side view of the pole member of FIG. 5 illustrating the pole member being collapsed within itself.
Figure 7:
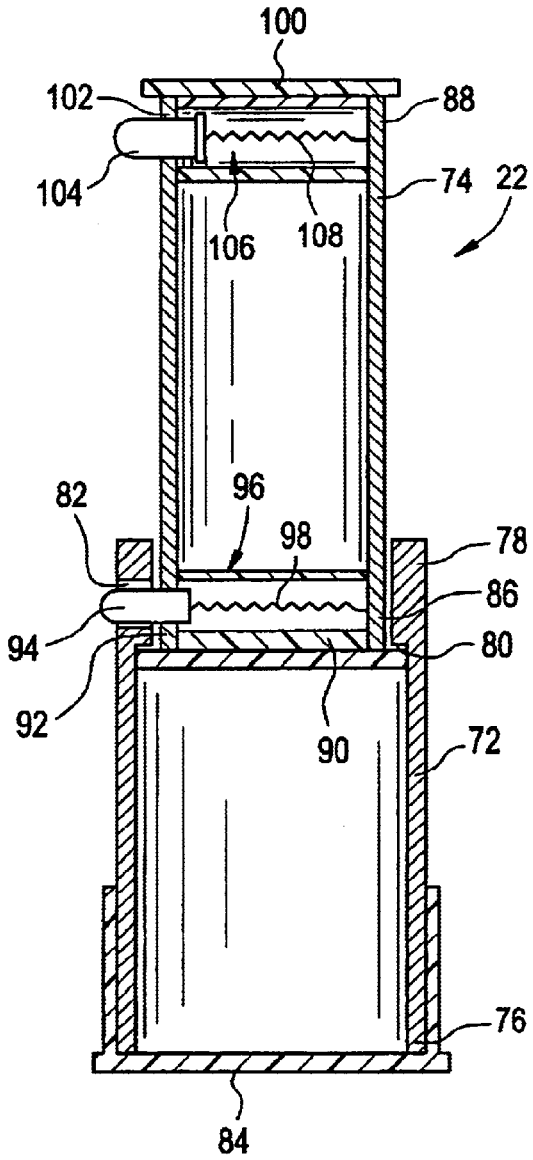
FIG. 7 is a cross-sectional side view of the pole member of FIG. 5 illustrating the pole member being extended.

Pole member 22 is illustrated in FIGS. 5–7 and includes an outer hollow tubular section 72 of substantially uniform outer diameter and an inner hollow tubular section 74 of substantially uniform outer diameter. Pole member 22 is known in the art and is discussed in detail in U.S. Pat. No. 4,385,849, entitled "Extensible And Retractable Rod", which is incorporated herein by reference.

As best illustrated in FIGS. 6 and 7, the outer tubular section 72 has a first end 76 and a second end 78. An inner shoulder 80 is provided in the outer tubular section 72 proximate to the second end 78 thereof such that the outer tubular section 72 has a smaller inner diameter proximate to the second end 78 thereof than the inner diameter proximate to the first end 76 thereof. An aperture 82 is provided through the outer tubular section 72 between the inner shoulder 80 and the second end 78 thereof. A plug member 84 is provided at the first end 76 of the outer tubular member 72 to close the first end 76 of the outer tubular member 72. The second end 78 of the outer tubular section 72 is open to receive and retain the inner tubular section 74.

As best illustrated in FIGS. 6 and 7, the inner tubular section 74 has a first end 86 and a second end 88. The inner tubular section 74 has an outer diameter which is slightly smaller than the inner diameter of the outer tubular section 72 at the second end 78 thereof such that the inner tubular section 74 is slidable within the outer tubular section 72.

A plug member 90 is provided at the first end 86 of the inner tubular member 74 to close the first end 86 of the inner tubular member 74. The plug member 90 has an outer diameter which is slightly smaller than the inner diameter of the outer tubular section 72 proximate to the second end 76 thereof, but which is larger than the inner diameter of the outer tubular section 72 proximate to the second end thereof 78. An aperture 92 is provided through the inner tubular section 74 proximate to the first end 86 thereof which allows a button 94 of a button/spring assembly 96 housed in the plug 90 to extend therethrough. The spring 98 of the button/spring assembly 96 allows the button 94 to move laterally to the left and to the right when viewed as in FIGS. 6 and 7.

A plug member 100 is provided at the second end 88 of the inner tubular member 74 to close the second end 88 of the inner tubular member 74. An aperture 102 is provided through the inner tubular section 74 proximate to the second end 88 thereof which allows a button 104 of a button/spring assembly 106 housed in the plug 100 to extend therethrough. The spring 108 of the button/spring assembly 106 allows the button 104 to move laterally to the left and to the right when viewed as in FIGS. 6 and 7. The button 104 may extend through the enlarged, generally circular portion 35 of the first portion 30 of the hook member 20 to attach the hook member 20 to the pole member 22, as illustrated in FIG. 5. If the button 104 is pushed into the plug member 100, the hook member 20 may be removed from the pole member 22 as desired.

The inner tubular section 74 may travel within the outer tubular section 72 to extend or retract the pole member 22. To keep the pole member 22 in an expanded position, the button 94 of the button/spring assembly 96 is allowed to extend through the aperture 82 of the outer tubular section 72, such that the inner tubular section 74 is locked into place relative to the outer tubular section 72.

It should be noted that the pole member 22 could have more sections than just the outer and inner tubular sections 72, 74 discussed herein should it be desirable to extend the pole member 22 further than the combined length of the outer and inner tubular sections 72, 74 when the pole member 22 is in the expanded position.

The pole member 22*a* is illustrated in FIGS. 8–11 and includes an outer hollow tubular section 72*a*, an inner hollow tubular section 74*a* and a pole retaining assembly 112. Pole member 22*a* is known in the art and is discussed generally in U.S. Pat. Nos. 4,105,239, 3,993,013, 3,936,206, 3,936,088 and 3,865,498.

Figure 9:
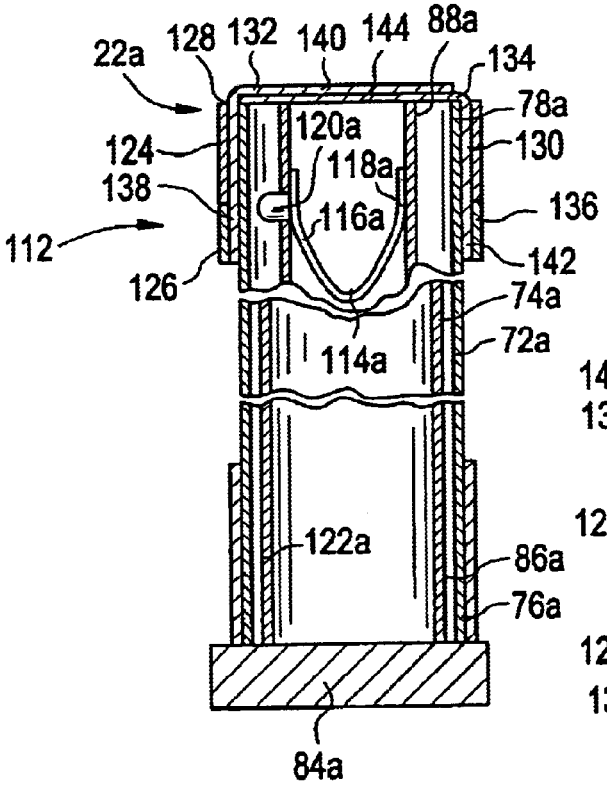
FIG. 9 is a cross-sectional side view of the pole member of FIG. 8 in a collapsed position and a retainer assembly retaining the pole member in a collapsed position.
Figure 10:
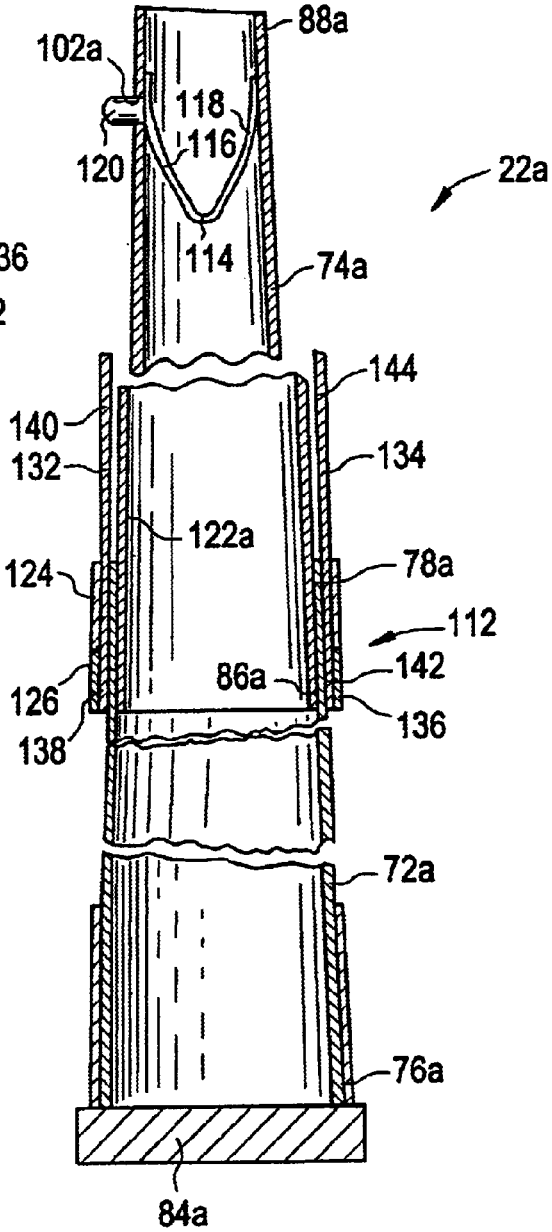
FIG. 10 is a cross-sectional side view of the pole member of FIG. 8 in an extended position and the retainer assembly allowing the pole member to be in an extended position.

As best illustrated in FIGS. 9 and 10, the outer tubular section 72*a* has a first end 76*a* and a second end 78*a*. The outer tubular section 72*a* is generally tapered such that the outer tubular section 72*a* has a larger diameter proximate to the first end 76*a* thereof than proximate to the second end 78*a* thereof. A plug member 84*a* is provided at the first end 76*a* of the outer tubular member 72*a* to close the first end 76*a* of the outer tubular member 72*a*. The second end 78*a* of the outer tubular section 72*a* is open to receive and retain the inner tubular section 74*a*.

As best illustrated in FIGS. 9 and 10, the inner tubular section 74*a* has a first end 86*a* and a second end 88*a*. The inner tubular section 74*a* is generally tapered such that the inner tubular section 74*a* has a larger diameter proximate to the first end 86*a* thereof than proximate to the second end 88*a* thereof. An outer diameter of the inner tubular section 74*a* proximate to the first end 86*a* thereof is slightly larger than an inner diameter of the outer tubular section 72*a* proximate to the second end 78*a* thereof. The inner tubular section 74*a* is slidable within the outer tubular section 72*a*.

A retractable pin member 114*a* is provided at the second end 88*a* of the inner tubular member 74*a*. The retractable pin member 114*a* is preferably U-shaped such that it has a first leg 116*a* and a second leg 118*a* extending from a base 119*a*. The first leg 116*a* has a button 120*a* which extends outwardly away from the first and second legs 116*a*, 118*a*. The pin member 114*a* is preferably formed of spring steel such that the legs 116*a*, 118*a* can moved toward one another upon an application of force and, upon the removal of the force, spring back to its normal position. An aperture 102*a* is provided through the inner tubular section 74*a* proximate to the second end 88*a* thereof which allows the button 120*a* of the pin member 114*a* to extend therethrough. The legs 116*a*, 118*a* of the pin member 114*a* are positioned against the inner wall 122*a* of the inner tubular section 74*a*. The button 120*a* may extend through the enlarged, generally circular portion 35 of the first portion 30 of the hook member 20 to attach the hook member 20 to the pole member 22*a*, as illustrated in FIG. 8. If the button 120*a* is pushed to move the leg 116*a* toward the leg 118*a* within the inner tubular section 74*a*, the button 120*a* will be moved out of the enlarged, generally circular portion 35 of the first portion 30 of the hook member 20 such that the hook member 20 may be removed from the pole member 22*a* as desired.

It should be noted that the retractable pin member 114*a* could be utilized in connection with the pole member 22 as opposed to the plug 100 and the button/spring assembly 106 housed within the plug 100. Similarly, it should be noted that the plug 100 and the button/spring assembly 106 housed within the plug 100 could be utilized in connection with the pole member 22*a* as opposed to the retractable pin member 114*a*.

The inner tubular section 74*a* may travel within the outer tubular section 72*a* to extend or retract the pole member 22*a*. To keep the pole member 22*a* in an expanded position, the first end 86*a* of the inner tubular section 74*a* is moved toward the second end 78*a* of the outer tubular section 72*a* to provide a friction fit or slip joint between the inner and outer tubular sections 74*a*, 72*a*, as the outer diameter of the inner tubular section 74*a* proximate to the first end 86*a* thereof is slightly larger than the inner diameter of the outer tubular section 72*a* proximate to the second end 78*a* thereof.

It should be noted that the pole member 22*a* could have more sections than just the outer and inner tubular sections 72*a*, 74*a* discussed herein should it be desirable to extend the pole member 22*a* further than the combined length of the outer and inner tubular sections 72*a*, 74*a* when the pole member 22*a* is in the expanded position.

The pole retaining assembly 112 is best illustrated in FIGS. 8–10 and includes a ring section 124 and a hook and loop assembly 126. The pole retaining assembly 112 can be utilized in connection with either the pole member 22 of the first embodiment of the tool 24 or with the pole member 22*a* of the second embodiment of the tool 24*a*, or for that matter any other types of extensible and retractable pole members. For illustration purposes, though, the pole retaining assembly 112 is illustrated and described herein only in connection with the pole member 22*a*.

Figure 16:
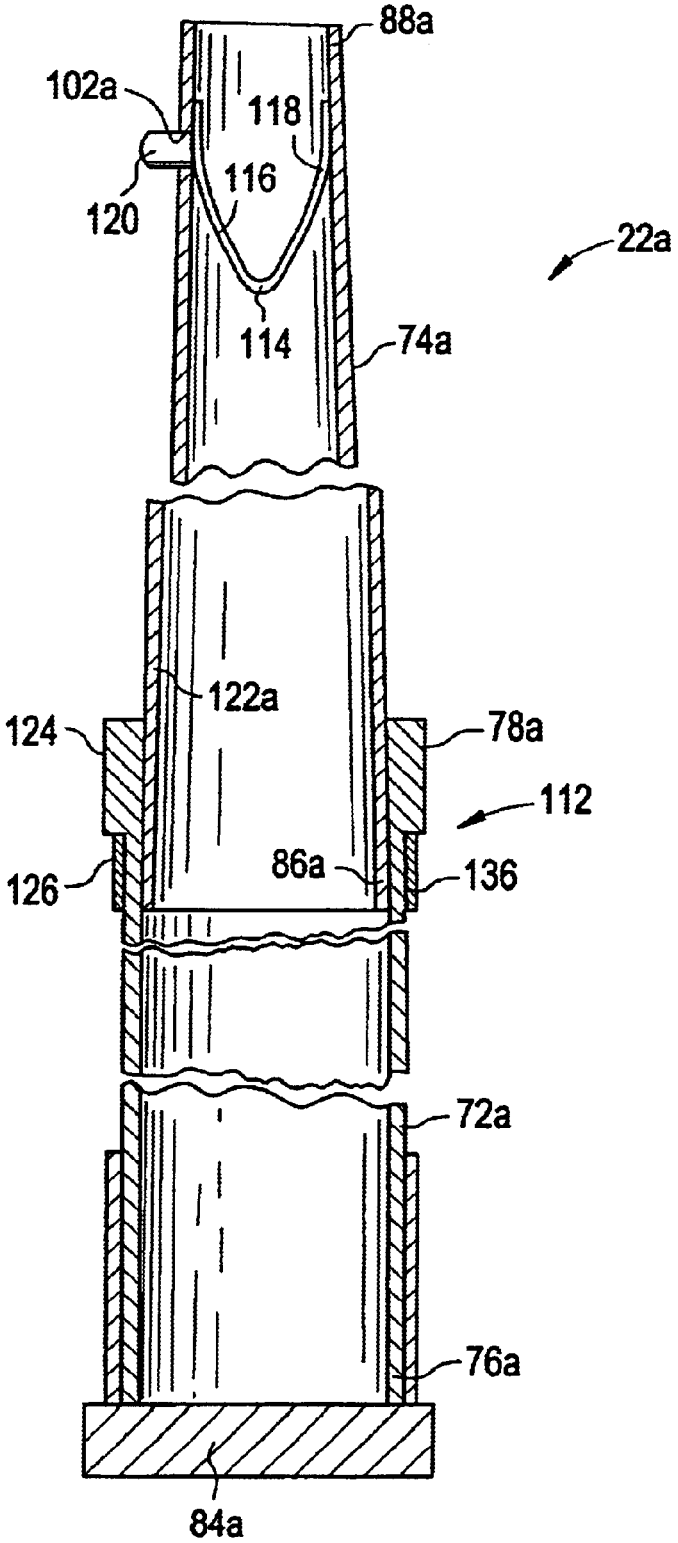
FIG. 16 is a cross-sectional side view of the pole member of FIG. 8 in an extended position and the retainer assembly allowing the pole member to be in an extended position, with a ring section of the retainer assembly being integrally formed with the pole member.

The ring section 124 of the pole retaining assembly 112 is positioned around the outer tubular section 72*a* of the pole member 22*a* at the second end 78*a* thereof. The ring section 124 is preferably attached to the outer tubular section 72*a* of the pole member 22*a* at the second end 78*a* thereof by appropriate means, such as by adhesive. The ring section 124 could also be integrally formed with the pole member 22*a* as illustrated in FIG. 16. The ring section 124 has a pair of slots 128, 130 provided therethrough which are positioned 180 degrees apart from one another. The ring section 124 is preferably formed of a fiberglass construction or of rubber.

The hook and loop assembly 126 includes first, second and third sections 132, 134, 136 which are at least partially formed of hook and loop fastener material commonly sold under the trademark VELCRO®. The first section 132 of the hook and loop assembly 126 extends through the slot 128 of the ring section 124 such that a first portion 138 thereof is positioned below the ring section 124 and such that an elongated second portion 140 thereof is positioned above the ring section 124, as shown in FIGS. 9 and 10. The second section 134 of the hook and loop assembly 126 extends through the slot 130 of the ring section 124 such that a first portion 142 thereof is positioned below the ring section 124 and such that an elongated second portion 144 thereof is positioned above the ring section 124, as shown in FIGS. 9 and 10. The third section 136 of the hook and loop assembly 126 extends around the outer tubular section 72*a* below the ring section 124, as shown in FIGS. 9 and 10, such that the third section 136 extends over the first portions 138, 142 of the first and second sections 132, 134, respectively, of the hook and loop assembly 126, thus attaching the third section 136 to the first and second sections 132, 134.

When the pole member 22*a* is collapsed within itself, such as in FIG. 9, the second portions 140, 144 of the first and second sections 132, 134, respectively, of the hook and loop assembly 126 can be folded one over the other to connect them together by fastening the loop portions of one of the portions 140, 144 with the hook portions of the other one of the portions 140, 144. When the collapsed pole member 22*a* is tipped down inadvertently, the inner tubular section 74*a* abuts against the connected second portions 140*a*, 144*a* of the first and second sections 132*a*, 134*a* of the pole retaining assembly 112*a* such that the second portions 140, 144 of the first and second sections 132, 134 prevent the inner tubular section 74*a* from sliding out of the outer tubular section 72*a* unexpectedly, thus retaining the inner tubular section 74*a* within the outer tubular section 72*a*. When the pole member 22*a* is to be extended, the second portions 140, 144 of the first and second sections 132, 134 can be separated by hand and retracted out of the way by moving the third section 136 down the outer tubular section 72*a*, away from the ring section 124, a short distance, for instance a few inches. The ring section 124 serves to guide and retain the hook and loop assembly 126 keeping it close to the outer tubular section 72*a* out of the line-of-sight of the user when working in limited spaces. In addition, the ring section 124 keeps the hook and loop assembly 126 from hanging up on structure as the pole member 22*a* is being used in small spaces.

Figure 11:
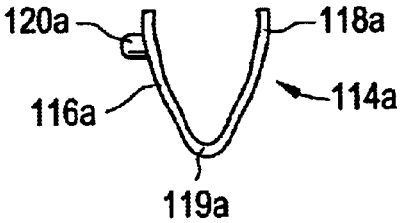
FIG. 11 is a side-elevational view of a pin member shown in FIGS. 8–10.

Operation of the tool 24, 24*a* will be discussed with relation to FIGS. 11–14. As best illustrated in FIG. 11, an overhead support member 28 is provided which has a workpiece 26, such as a wire, hanging thereover such that a first portion 110 of the workpiece 26 hangs from a first side 112 of the overhead support member 28 and a second portion 114 of the workpiece 26 hangs from a second side 116 of the overhead support member 28. One of the portions 110, 114 may be shorter than the other.

Once the workpiece 26 is positioned around the overhead support member 28 to provide both a first portion 110 and a second portion 114, a user uses the tool 24, 24*a* to twist the second portion 114 of the workpiece 26 around the first portion 110 of the workpiece 26 to secure the second portion 114 to the first portion 110, thus securing the workpiece 26 to the overhead support member 28.

The user moves the pole member 22, 22*a* to an extended position as illustrated in FIGS. 5 and 8. If the pole retaining assembly 112 is provided on the pole member 22, 22*a*, the user would first unfasten the second portions 140, 144 of the first and second sections 132, 134 of the hook and loop assembly 126. The user could then move the third section 136 of the hook and loop assembly 126 away from the open end 78*a* of the outer tubular section 72*a* in order to move the second portions 140, 144 of the first and second sections 132, 134 out of the line-of-sight of the user and to prevent same from getting hung-up on other structures.

Figure 12:
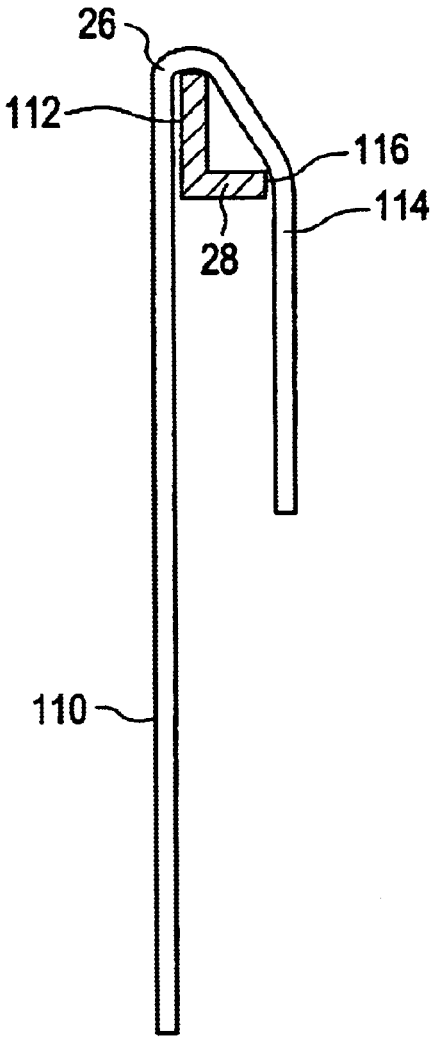
FIGS. 12–15 illustrate the method of using the hook member, with a pole member attached thereto, to twist a first portion of a workpiece around a second portion of a workpiece in order to secure the workpiece to an overhead support member.

The user moves the tool 24, 24*a* upwardly, generally from the ground or floor, toward the first portion 110 of the workpiece 26. The tool 24, 24*a* is then moved such that the first portion 110 of the workpiece 26 extends through the aperture 56 of the fourth portion 50 of the hook member 20, and is then moved such that the first portion 110 of the workpiece 26 extends through the aperture 43 of the second portion 36 of the hook member 20, such that the first portion 110 of the workpiece 26 is secured within the apertures 56, 43 of the hook member 20. The apertures 43, 56 are sized to accept the first portion 110 of the workpiece 26. The tool 24, 24*a* is then moved such that the second portion 114 of the workpiece 26 is positioned in one of the notches 58, 60 provided along the outer edges 62, 64 of the fourth portion 50 (FIG. 12 illustrates the second portion 114 of the workpiece 26 being positioned in notch 60 of outer edge 64), such that the second portion 114 of the workpiece 26 is secured by the notches 58, 60 of the hook member 20. The notches 58, 60 are sized to accept the second portion 114 of the workpiece 26.

Figure 13:
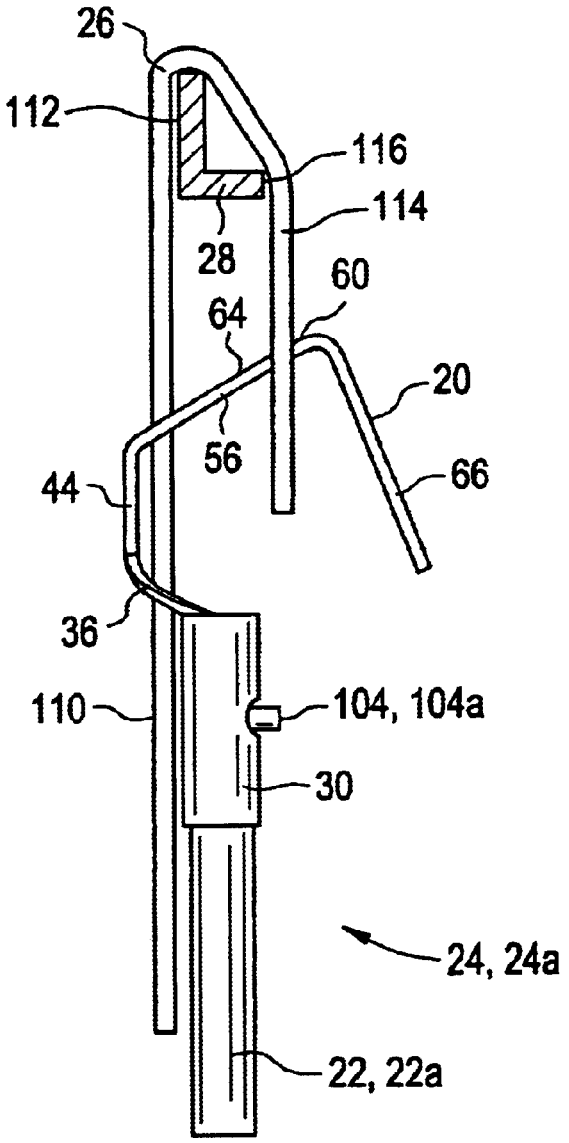
Figure 14:
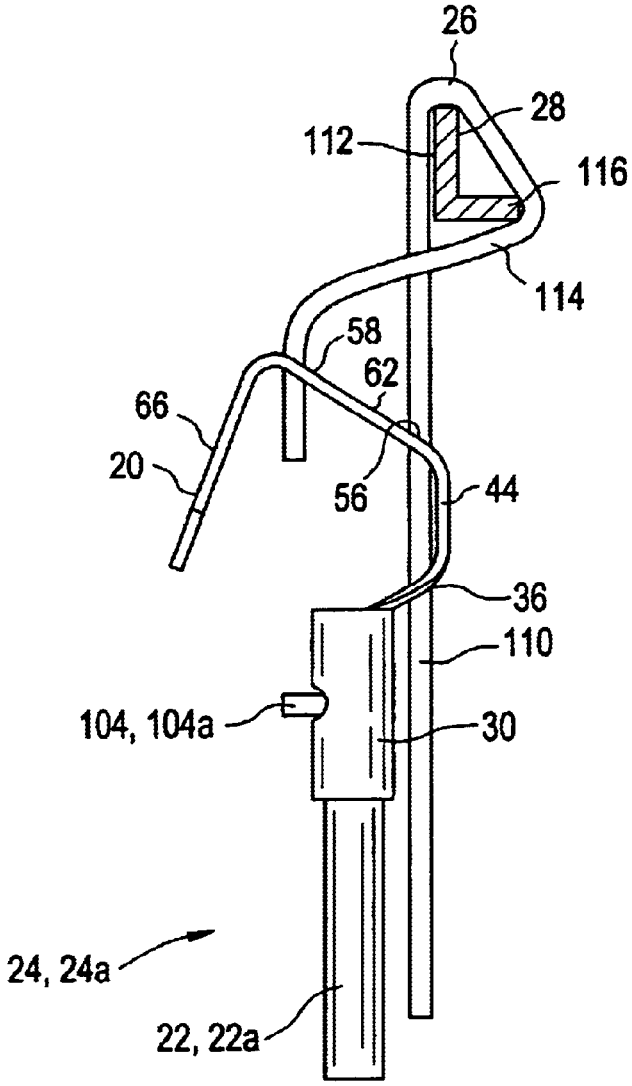

As illustrated in FIG. 13, the pole member 22, 22*a* is then rotated clockwise such that the first portion 110 of the workpiece 26 stays secure and rotates within the apertures 43, 56 of the hook member 20 while the fourth portion 50 of the hook member 20 abuts against the second portion 114 of the workpiece 26 to twist the second portion 114 around the first portion 110 of the workpiece 26, with the notch 60 keeping the second portion 114 in contact with the hook member 20, preventing it from slipping. Of course, it should be noted that if the second portion 114 of the workpiece 26 were secured in notch 58 along the outer edge 62 of the fourth portion 50, the pole member 22, 22*a* would be rotated counter-clockwise in order to twist the second portion 114 about the first portion 110.

Figure 15:
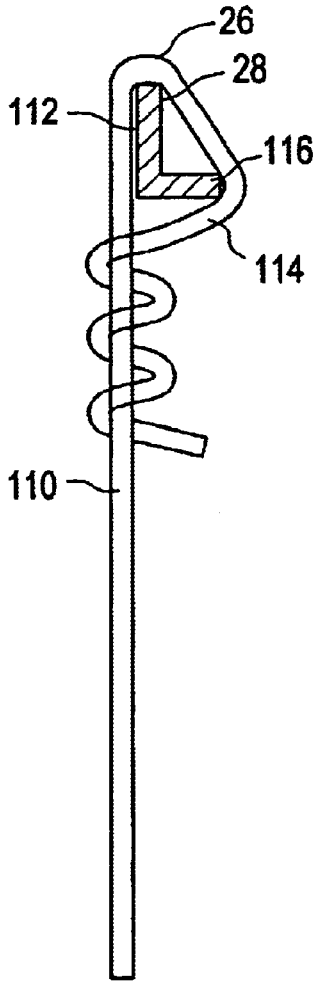

Continued rotation of the pole member 22, 22*a* continues the twisting of the second portion 114 around the first portion 110. The second portion 114 can be twisted around the first portion 110 as many times as desired. For example, as illustrated in FIG. 15, the second portion 114 can be twisted around the first portion 110 three (3) times.

Once the second portion 114 is twisted around the first portion 110 as many times as desired, the user then lowers the tool 24, 24*a* such that the first portion 110 of the workpiece 26 is removed from aperture 43 of the second portion 36 and then aperture 56 of the fourth portion 50, and such that the second portion 114 is no longer in contact with the notch 60 along the outer edge 64 of the fourth portion 50. As a result, the second portion 114 is twisted around the first portion 110 such that the workpiece 26 is secured to itself, as well as to the overhead support member 28.

It should be noted that the apertures 43, 56 through which the first portion 110 of the workpiece 26 is positioned, could instead be formed as notches provided along one of the outer edges of the second and fourth portions 36, 50, respectively, similar to the notches 58, 60 provided on the fourth portion 50. Rotation of the pole member 22, 22*a*, though, would only be allowed in one direction, depending on which of the outer edges of the second and fourth portions 36, 50 the notches were provided on.

It should also be noted that the notches 58, 60 which the second portion 114 of the workpiece 26 abut against could instead be formed as an aperture through the fourth portion 50, similar to the apertures 43, 56.

While preferred embodiments of the present invention are shown and described, it is envisioned that those skilled in the art may devise various modifications of the present invention without departing from the spirit and scope of the appended claims.

What is claimed is:

1. A combination comprising:

an extensible and retractable pole assembly including an outer pole kind at least one inner pole which is configured to be extensible and retractable within said outer pole; and a retainer assembly configured to retain said at least one inner pole within said outer pole when said at least one inner pole is retracted within said outer pole, said retainer assembly including, a first section having first and second portions, a second section having first and second portions, said first portions of said first and second sections capable of fastening to one another across an open end of said outer pole to retain said at least one inner pole within said outer pole, and a third section positioned around said outer pole said third section being fastened to said second portions of said first and second sections.

2. A combination as defined in claim 1, wherein said first, second and third sections are at least partially formed of hook and loop fastener material.

3. A combination as defined in claim 1, further including a ring section connected to and positioned around said open end of said outer pole, said ring section having a pair of slots provided therethrough which are opposite one anther, said first section extending through one of said slots of said ring section such that said first and second portions of said first section are provided on opposite sides of said ring section, said second section extending through the other one of said slots of said ring section such that said first and second portions of said second section are provided on opposite sides of said ring section.

4. A combination as defined in claim 1, further including a ring section integrally formed with and positioned around the open end of the outer pole, said ring section having a pair of slots provided therethrough which are opposite one another, said first section extending through one of said slots of said ring section such that said first and second portions or said first section are provided on opposite sides of said ring section, said second section extending through the other one of said slots of said ring section such that said first and second portions of said second section are provided on opposite sides of said ring section.

5. A combination as defined in claim 1, further including a ring section positioned around said open end of said outer pole, said ring section having a pair of slots provided therethrough which are opposite one another, said first section extending through one of said slots of said ring section such that said first and second portions of said first section are provided on opposite sides of said ring section, said second section extending through the outer one of said slots of said ring section such that said first and second portions of said second section are provided on opposite sides of said ring section.

* * * * *